US012624653B2

(12) United States Patent
Kagami et al.

(10) Patent No.: US 12,624,653 B2
(45) Date of Patent: May 12, 2026

(54) VEHICLE PUMP ASSEMBLY AND OFF-ROAD VEHICLE

(71) Applicant: KAWASAKI MOTORS, LTD., Hyogo (JP)

(72) Inventors: Sho Kagami, Akashi (JP); Atsushi Tajima, Akashi (JP); Yoshihiko Inagaki, Akashi (JP)

(73) Assignee: KAWASAKI MOTORS, LTD., Hyogo (JP)

( * ) Notice: Subject to any disclaimer, the term of this patent is extended or adjusted under 35 U.S.C. 154(b) by 355 days.

(21) Appl. No.: 18/437,447

(22) Filed: Feb. 9, 2024

(65) Prior Publication Data

US 2025/0257681 A1 Aug. 14, 2025

(51) Int. Cl.

| | |
|---|---|
| ***F01P 5/12*** | (2006.01) |
| ***F01P 11/02*** | (2006.01) |
| ***F01P 11/04*** | (2006.01) |

(52) U.S. Cl.

CPC ..... *F01P 5/12* (2013.01); *F01P 11/0276* (2013.01); *F01P 11/04* (2013.01)

(58) Field of Classification Search

CPC ..... F01P 5/12; F01P 11/0276; F01P 11/04; F01P 5/10

See application file for complete search history.

(56) References Cited

U.S. PATENT DOCUMENTS

| | | | | |
|---|---|---|---|---|
| 5,191,859 | A * | 3/1993 | Fujiwara | F01P 5/10 123/41.47 |
| 5,217,350 | A * | 6/1993 | Kimura | F04D 29/128 415/177 |
| 5,338,153 | A * | 8/1994 | Swanson | F16J 15/004 415/168.2 |
| 5,355,847 | A * | 10/1994 | Ozeki | F04D 29/588 415/176 |
| 2006/0278451 | A1 | 12/2006 | Takahashi et al. | |
| 2007/0101952 | A1* | 5/2007 | Fujimoto | F01P 5/12 123/41.44 |
| 2013/0094976 | A1* | 4/2013 | Murakami | F04D 29/426 417/313 |
| 2016/0102600 | A1* | 4/2016 | Pates | F04D 13/02 220/571 |

FOREIGN PATENT DOCUMENTS

| | | | | |
|---|---|---|---|---|
| CA | 2281342 | A1 * | 3/2000 | F04C 18/02 |
| CA | 2209286 | C * | 10/2000 | B60H 1/038 |
| CN | 115263521 | A * | 11/2022 | F01P 5/10 |
| DE | 4318158 | A1 * | 2/1994 | F04D 15/0005 |
| DE | 19639930 | A1 * | 4/1997 | F04D 29/108 |

(Continued)

*Primary Examiner* — Hung Q Nguyen

(74) *Attorney, Agent, or Firm* — Studebaker Brackett PLLC

(57) ABSTRACT

A vehicle pump assembly 13 includes a pump 30 having a mechanical seal 35 sealing a cooling medium and a drain hose 50 attached to the pump 30. The pump 30 includes an introduction chamber 40 separated by the mechanical seal 35 and configured such that the cooling medium having leaked from the mechanical seal 35 is introduced thereinto, and the drain hose 50 communicates with the introduction chamber 40. The internal volume of the drain hose 50 is three times the volume of the introduction chamber 40 or more.

11 Claims, 9 Drawing Sheets

(56) References Cited

FOREIGN PATENT DOCUMENTS

| | | | | | |
|---|---|---|---|---|---|
| DE | 102012204884 | A1 | * | 10/2012 | F01P 11/04 |
| DE | 102015117126 | A1 | * | 4/2016 | F01P 11/02 |
| EP | 428210 | A | * | 5/1991 | |
| EP | 1048851 | A2 | * | 11/2000 | F04D 29/086 |
| IT | TO20120214 | A1 | * | 10/2012 | F01P 11/04 |
| JP | H0356899 | U | * | 5/1991 | |
| JP | H0734174 | Y2 | * | 8/1995 | |
| JP | H0988592 | A | * | 3/1997 | F01P 11/02 |
| JP | H1077861 | A | * | 3/1998 | F02B 61/02 |
| JP | 2000297642 | A | * | 10/2000 | |
| JP | 2002285998 | A | * | 10/2002 | F04D 29/106 |
| JP | 2002364585 | A | * | 12/2002 | |
| JP | 3383888 | B2 | * | 3/2003 | |
| JP | 2004092495 | A | * | 3/2004 | |
| JP | 2021099088 | A | * | 7/2021 | F01P 5/10 |
| JP | 2021156167 | A | * | 10/2021 | |
| KR | 19980043454 | U | * | 9/1998 | F04D 29/106 |
| KR | 19980043616 | U | * | 9/1998 | F01P 5/12 |
| KR | 20030072006 | A | * | 9/2003 | F01P 5/10 |
| KR | 20050003084 | A | * | 1/2005 | |
| KR | 20090063746 | A | * | 6/2009 | F16H 55/36 |
| KR | 20090063918 | A | * | 6/2009 | F01P 5/12 |
| KR | 20100072911 | A | * | 7/2010 | F04D 29/106 |
| KR | 101063226 | B1 | * | 9/2011 | F01P 11/0276 |
| KR | 20120030877 | A | * | 3/2012 | F01P 5/10 |
| KR | 101251501 | B1 | * | 4/2013 | F01P 5/10 |
| KR | 102227967 | B1 | * | 3/2021 | F01P 5/10 |

* cited by examiner

VEHICLE PUMP ASSEMBLY AND OFF-ROAD VEHICLE

FIELD

The technique disclosed here relates to a vehicle pump assembly and an off-road vehicle.

BACKGROUND

U.S. Patent Application Publication No. 2006/0278451 discloses a vehicle pump assembly. The vehicle pump assembly has a pump that supplies coolant water to an engine.

SUMMARY

The pump of the vehicle pump assembly as described above has a mechanical seal that seals the coolant water. The pump has an introduction chamber into which the coolant water having leaked from the mechanical seal is introduced. The introduction chamber communicates with the outside through a water drain hole. The coolant water introduced into the introduction chamber is discharged to the outside through the water drain hole.

For example, when a user drives a vehicle and the pump is exposed to outside water accumulated on the ground, such as muddy water, there is a probability that the outside water is sucked through the water drain hole and the sucked outside water enters the introduction chamber of the pump.

The technique disclosed here has been made in view of the above-described point, and an object thereof is to reduce entrance of the outside water into the introduction chamber of the pump.

A vehicle pump assembly disclosed here includes a pump having a mechanical seal sealing a cooling medium and a drain hose attached to the pump. The pump includes an introduction chamber separated by the mechanical seal and configured such that the cooling medium having leaked from the mechanical seal is introduced thereinto, and the drain hose communicates with the introduction chamber. The internal volume of the drain hose is three times the volume of the introduction chamber or more.

An off-road vehicle disclosed here includes an engine and a vehicle pump assembly that supplies a cooling medium to the engine. The vehicle pump assembly includes a pump having a mechanical seal sealing the cooling medium and attached to the engine, and a drain hose attached to the pump. The pump includes an introduction chamber separated by the mechanical seal and configured such that the cooling medium having leaked from the mechanical seal is introduced thereinto, and the drain hose communicates with the introduction chamber. The internal volume of the drain hose is three times the volume of the introduction chamber or more.

The above-described vehicle pump assembly can be configured such that entrance of outside water into the introduction chamber of the pump is reduced.

The above-described off-road vehicle can be configured such that entrance of outside water into the introduction chamber of the pump is reduced.

DESCRIPTION OF EMBODIMENTS

Figure 1:
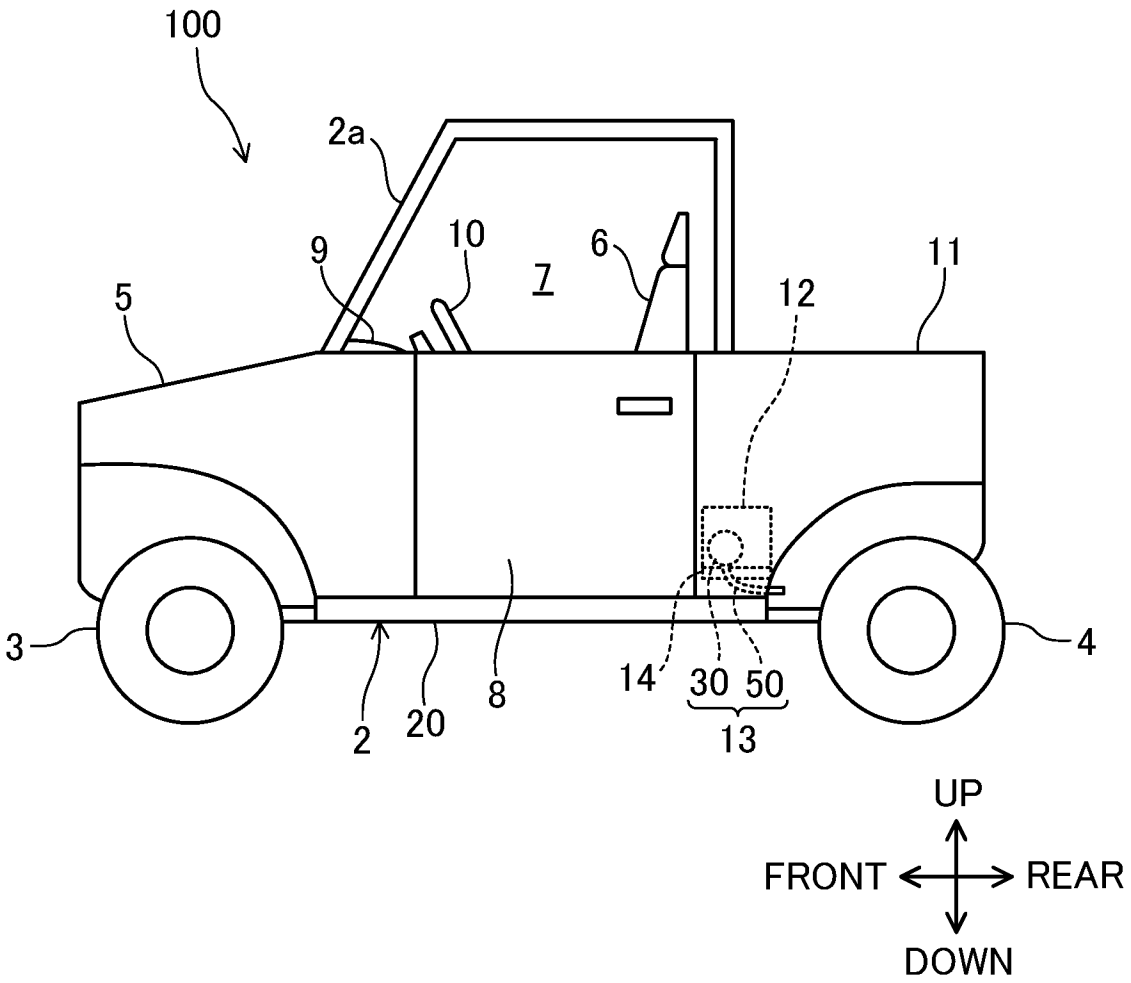
FIG. 1 is a left side view of a utility vehicle according to an embodiment.

Hereinafter, an exemplary embodiment will be described in detail with reference to the drawings. FIG. 1 is a left side view of a utility vehicle 100. The utility vehicle 100 can travel off road. The utility vehicle 100 is one example of an off-road vehicle. Hereinafter, the utility vehicle 100 will also be merely referred to as a "vehicle 100."

In the present disclosure, each component of the vehicle 100 will be described using a direction with respect to the vehicle 100. Specifically, a "front" means the front of the vehicle 100 in a vehicle front-rear direction, and a "rear" means the rear of the vehicle 100 in the vehicle front-rear direction. A "left" means the left when facing the front of the vehicle 100, and a "right" means the right when facing the front of the vehicle 100. A "width direction" means the vehicle width direction of the vehicle 100, and in other words, means the right-left direction of the vehicle 100 and will also be referred to as a "right-left direction." A "vehicle-width inside" means a vehicle interior side in the width direction, and a "vehicle-width outside" means a vehicle outer side in the width direction. Each direction with respect to a vehicle pump assembly 13 is coincident with a corresponding direction with respect to the vehicle 100 when the vehicle pump assembly 13 is incorporated into the vehicle 100. For example, the front-rear direction of the vehicle pump assembly 13 is coincident with the front-rear direction of the vehicle 100 when the vehicle pump assembly 13 is incorporated into the vehicle 100.

The vehicle 100 includes a vehicle body frame 2, right and left front wheels 3 supporting a front portion of the vehicle body frame 2, and right and left rear wheels 4 supporting a rear portion of the vehicle body frame 2. That is, the vehicle 100 is a four-wheeled automobile. A space between the right and left front wheels 3 is covered with a hood 5 from above. Right and left seats 6 supported on the vehicle body frame 2 are located on the rear side of the hood 5.

The vehicle body frame 2 includes hollow pipes 20, and the pipes 20 are connected into the frame. The vehicle body frame 2 has a cabin frame 2*a* defining a vehicle interior 7 in which the seats 6 are located. Entrances are opened on both right and left sides of the vehicle interior 7, and are closed with doors 8. A dashboard 9 is located in front of the seats 6 in the vehicle interior 7. A steering wheel 10 is attached to the dashboard 9. A cargo bed 11 is located in rear of the cabin frame 2*a*. The cargo bed 11 includes a recessed loading space opened upward.

The vehicle 100 has an engine 12 and the vehicle pump assembly 13. The engine 12 is located in rear of the seats 6 and below the cargo bed 11. That is, the engine 12 is positioned between the front wheels 3 and the rear wheels 4. The vehicle pump assembly 13 is attached to the engine 12 to supply a cooling medium to the engine 12. The vehicle 100 further has an oil pan 14, and the oil pan 14 is attached to the engine 12 to store engine oil. The oil pan 14 is attached to a lower portion of the engine 12, specifically the bottom of the engine 12. A transmission that changes an output engine speed is attached to the engine 12. A radiator that cools the cooling medium is coupled to the engine 12. The cooling medium is, for example, coolant water, but may be other cooling media.

Figure 2:
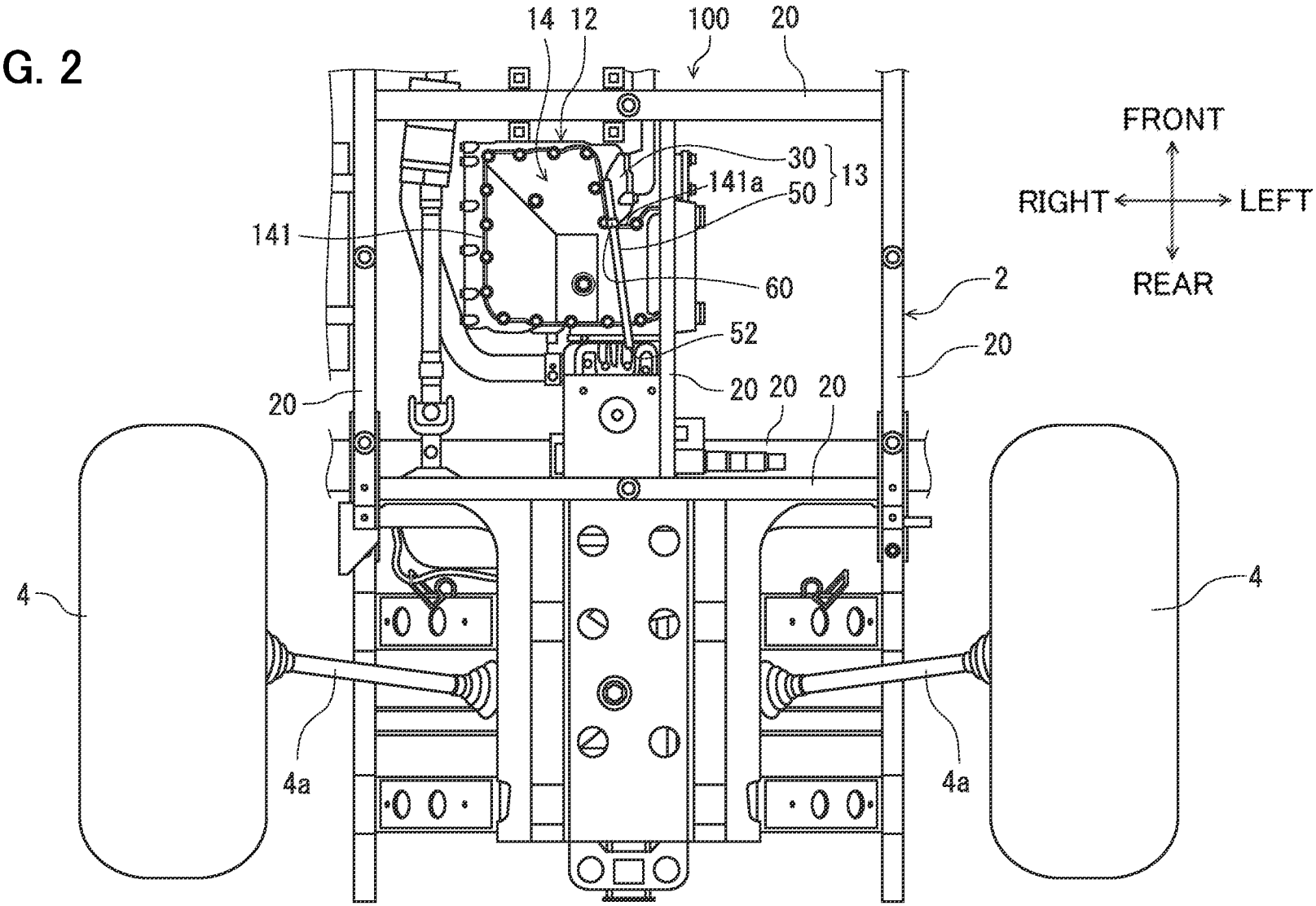
FIG. 2 is a bottom view of the utility vehicle from below.
Figure 3:
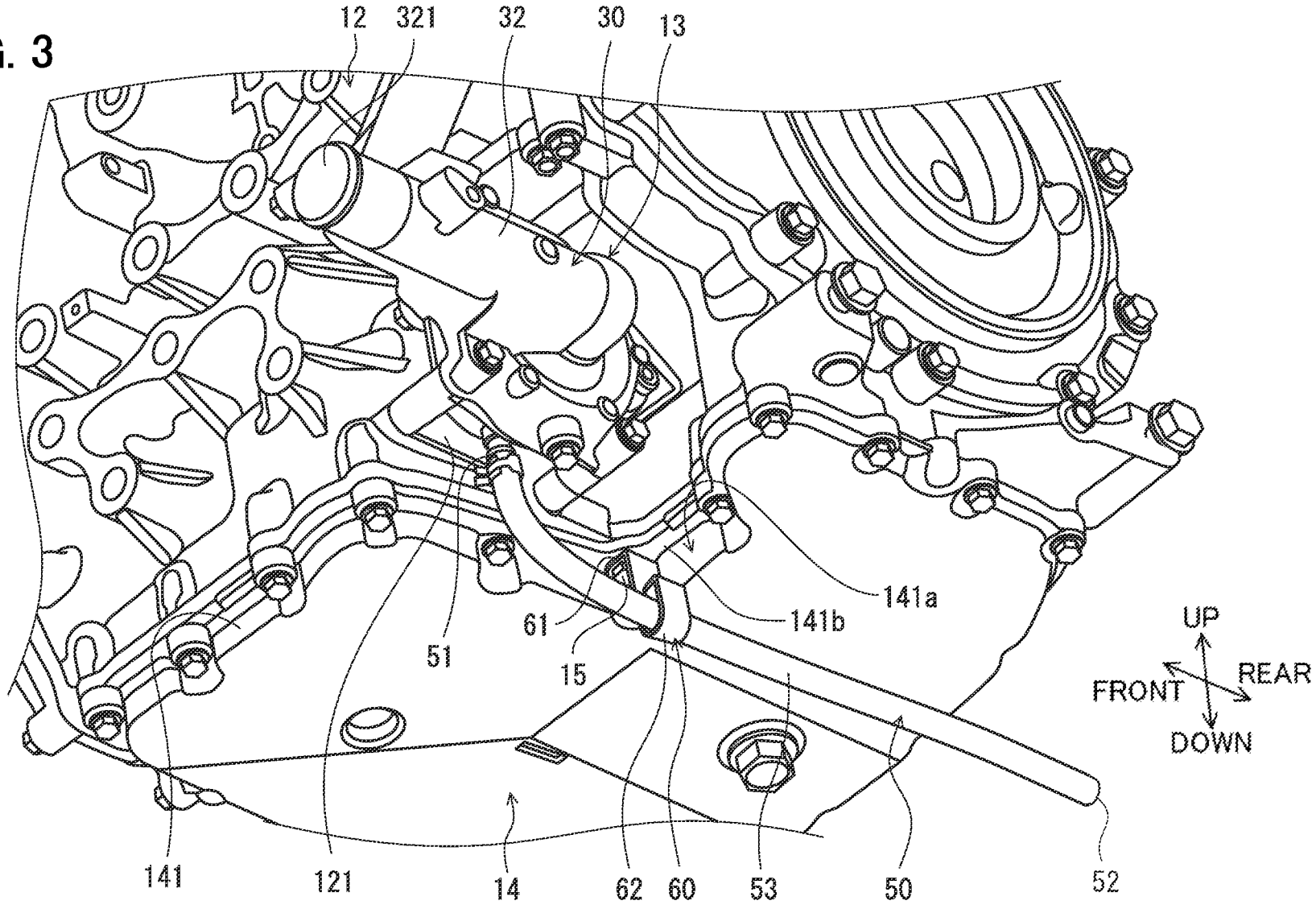
FIG. 3 is a perspective view showing, from below, an engine, a vehicle pump assembly, and an oil pan.

FIG. 2 is a bottom view of the vehicle 100 from below. FIG. 2 mainly shows the vehicle body frame 2, the rear wheels 4, the engine 12, the vehicle pump assembly 13, and the oil pan 14. FIG. 3 is a perspective view of the engine 12, the vehicle pump assembly 13, and the oil pan 14 from below.

The vehicle pump assembly 13 has a pump 30 attached to the engine 12 and a drain hose 50 attached to the pump 30.

The pump 30 is attached to an engine case 121 of the engine 12. The engine case 121 is, for example, a crankcase. The pump 30 is, for example, a centrifugal pump, and circulates the cooling medium between the engine 12 and the radiator. For the sake of convenience, a pipe connecting the pump 30 and the engine 12 to each other and a pump connecting the pump 30 and the radiator to each other are not shown in FIGS. 2 and 3.

The drain hose 50 discharges the cooling medium having leaked from the pump 30 to the outside. The material of the drain hose 50 is, for example, a rubber material such as ethylene propylene diene methylene linkage (EPDM). The drain hose 50 has flexibility, for example. The drain hose 50 has an inlet 51 and an outlet 52. The inlet 51 is connected to the pump 30, and the outlet 52 is opened to the outside. The drain hose 50 causes the cooling medium to flow from the inlet 51 to the outlet 52.

The outlet 52 of the drain hose 50 faces the rear of the vehicle. Specifically, the drain hose 50 extends in the front-rear direction such that the inlet 51 is positioned in front and the outlet 52 is positioned in rear.

The drain hose 50 is continuously inclined so as to be positioned lower as extending to the outlet 52. Specifically, a portion of the drain hose 50 in the vicinity of the inlet 51 extends substantially in the vertical direction. A portion of the drain hose 50 between the portion in the vicinity of the inlet 51 and the outlet 52 is inclined with a substantially constant inclination. Note that the inclination may be changed in the middle in the portion of the drain hose 50 between the portion in the vicinity of the inlet 51 and the outlet 52.

The outlet 52 of the drain hose 50 is positioned, as viewed from below, between the rear end of the engine 12 and the front ends of the rear wheels 4. Specifically, as viewed from below, the outlet 52 is positioned in rear with respect to the rear end of the engine 12 and in front with respect to the front ends of the rear wheels 4. Note that the outlet 52 may be positioned, as viewed from below, in front with respect to axles 4*a* of the rear wheels 4.

The drain hose 50 is supported by a support 60. The support 60 is, for example, a clamp. Specifically, the support 60 supports the drain hose 50 on the side closer to the inlet 51 with respect to an intermediate portion 53 of the drain hose 50. The support 60 is attached to the oil pan 14.

A peripheral wall 141 of the oil pan 14 includes a recess 141*a*, and the support 60 is attached to the recess 141*a*. Specifically, the recess 141*a* is opened to the front and the left as viewed from below. That is, the peripheral wall 141 is, as viewed from below, in such a shape that one corner portion of a substantially rectangular shape is cut out.

The support 60 is fixed to the oil pan 14 with a bolt 15. The bolt 15 also serves as, for example, a bolt for attaching the oil pan 14 to the engine case 121. Note that the bolt 15 may be a bolt only for attaching the support 60 to the oil pan 14.

The support 60 is obtained in such a manner that a metal plate is bent. The support 60 has an attachment 61 fastened to the oil pan 14 with the bolt 15 and a support 62 supporting the drain hose 50. The support 62 is bent in a U-shape. The drain hose 50 penetrates the support 62, and is hooked on the support 62.

Figure 4:
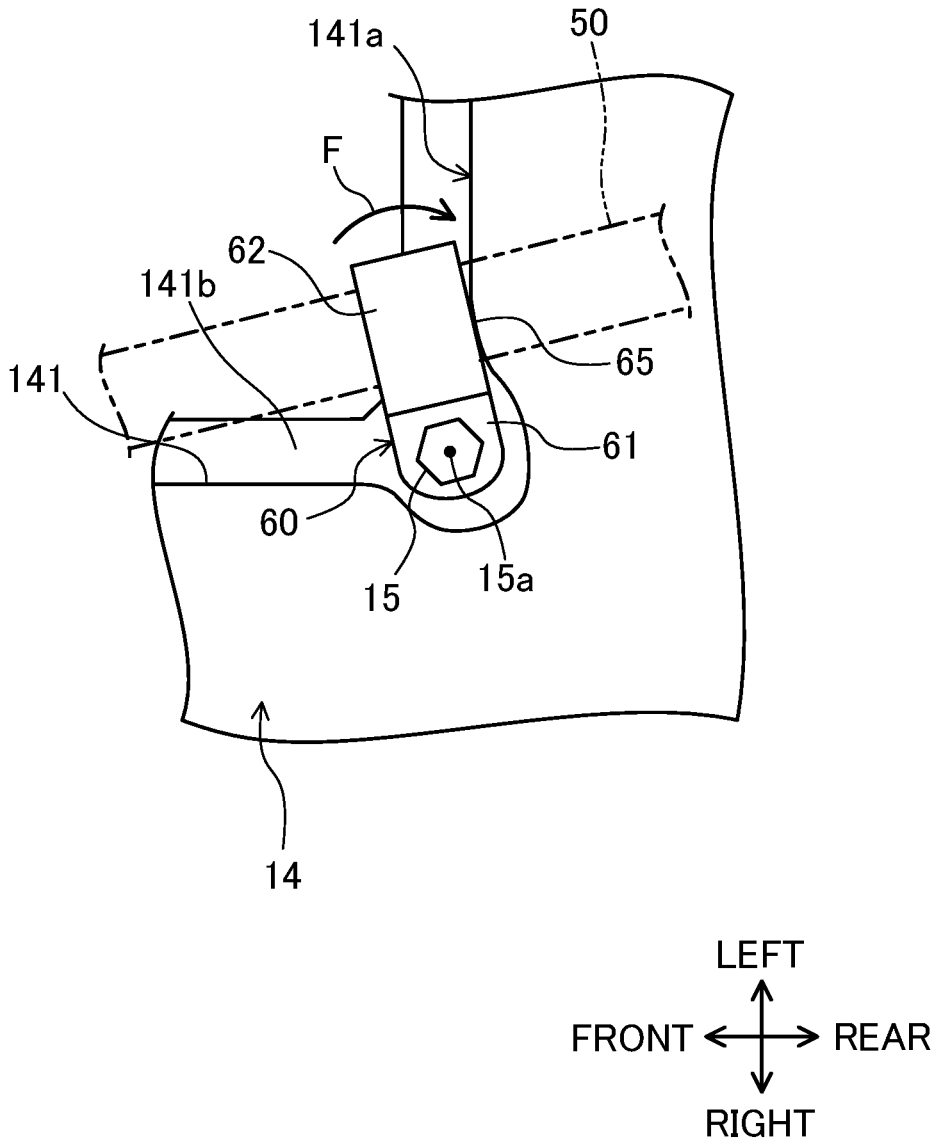
FIG. 4 is a bottom view showing, from below, a support attached to the oil pan with a bolt.

FIG. 4 is a bottom view showing, from below, the support 60 attached to the oil pan 14 with the bolt 15. The peripheral wall 141 has a stepped portion 141*b* expanding in the horizontal direction, and the bolt 15 is attached to the stepped portion 141*b*. The axis 15*a* of the bolt 15 is coincident with the vertical direction, i.e., an up-down direction. As viewed in the direction of the axis 15*a*, the support 60 has an end portion 65 (hereinafter also referred to as a fastening-side end portion 65) positioned in a fastening direction F of the bolt 15. The fastening-side end portion 65 contacts the inner surface of the recess 141*a* as viewed in the direction of the axis 15*a*. In this example, the fastening-side end portion 65 is equivalent to an end portion of the support 62.

Figure 5:
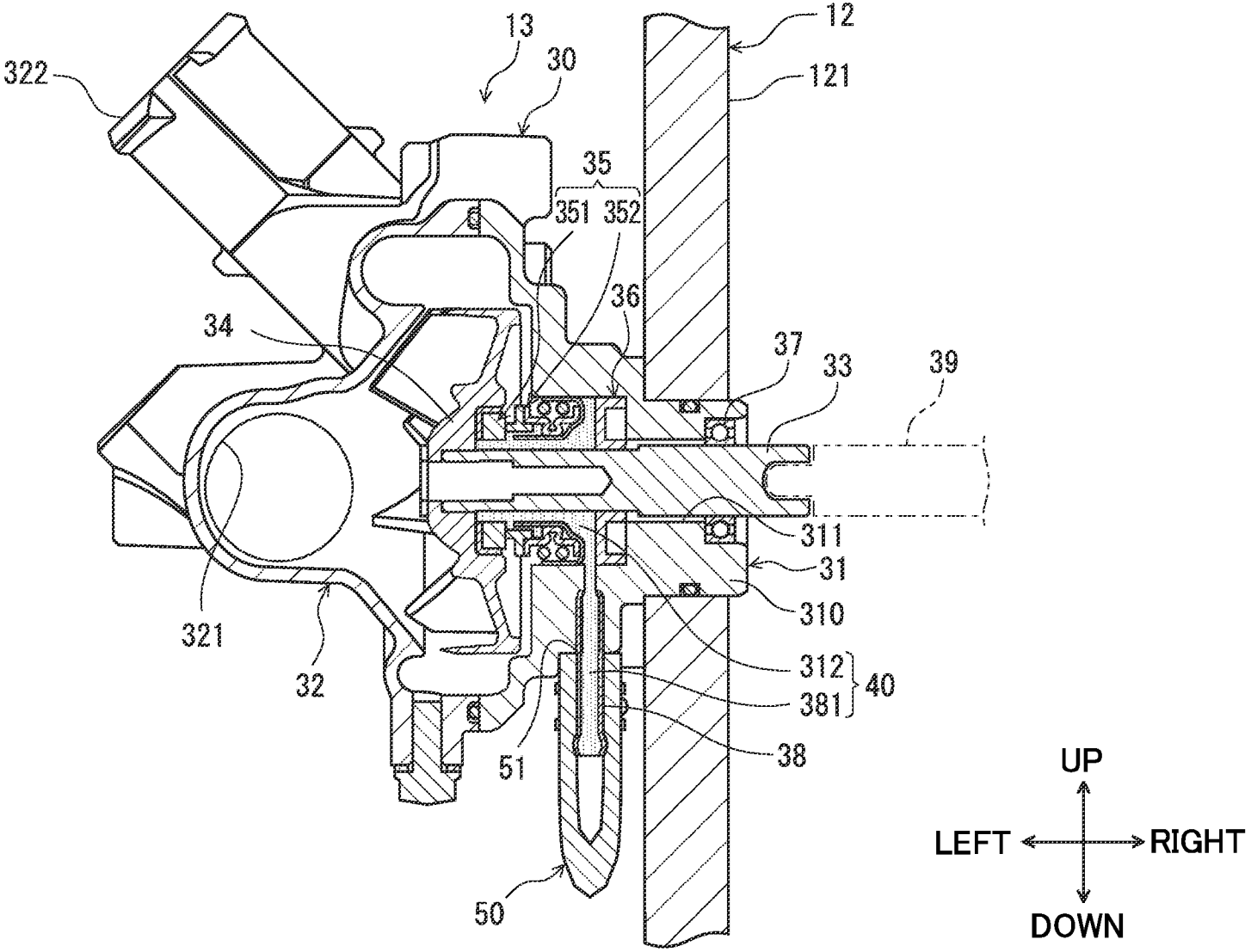
FIG. 5 is a sectional view of the vehicle pump assembly attached to the engine.

FIG. 5 is a sectional view of the vehicle pump assembly 13 attached to the engine 12. The pump 30 has a pump housing 31 and a pump cover 32. The pump housing 31 is attached to the engine case 121. A boss 310 of the pump housing 31 is inserted into a hole of the engine case 121. The pump cover 32 is attached to the pump housing 31. The pump cover 32 includes a suction port 321 and a discharge port 322. The suction port 321 communicates with the radiator, and the cooling medium is sucked into the suction port 321 from the radiator. The discharge port 322 communicates with a jacket (not shown) of the engine 12, and the cooling medium is discharged to the engine 12 from the discharge port 322.

The pump housing 31 includes a shaft insertion hole 311 through which the boss 310 penetrates. A pump shaft 33 is inserted into the shaft insertion hole 311. A bearing 37 is located between the pump shaft 33 and the boss 310 of the pump housing 31. That is, the pump shaft 33 is rotatably supported on the boss 310 of the pump housing 31 through the bearing 37.

A first end portion of the pump shaft 33 protrudes into the pump cover 32. Specifically, in the pump cover 32, the first end portion of the pump shaft 33 is located in a region where the cooling medium is housed. On the other hand, a second end portion of the pump shaft 33 protrudes into the engine case 121. Specifically, in the engine case 121, the second end portion of the pump shaft 33 is located in a region where the engine oil is housed.

An impeller 34 is fixed to the first end portion of the pump shaft 33. The impeller 34 is located in the pump cover 32. The impeller 34 rotates together with the pump shaft 33.

A transmission shaft 39 is coupled to the second end portion of the pump shaft 33. The transmission shaft 39 is coupled to a crankshaft, for example, through a gear. With this configuration, rotation of the crankshaft is transmitted to the pump shaft 33 through the gear and the transmission shaft 39, and the impeller 34 rotates along with rotation of the pump shaft 33.

The pump 30 has a mechanical seal 35 and an oil seal 36. The mechanical seal 35 and the oil seal 36 are located between the pump housing 31 and the pump shaft 33. The mechanical seal 35 is located on the side closer to the first end portion of the pump shaft 33 with respect to the oil seal 36. The mechanical seal 35 seals the cooling medium in the pump cover 32. The oil seal 36 seals the engine oil in the engine case 121.

The mechanical seal 35 has a rotary seal 351 and a fixed seal 352. The rotary seal 351 is fixed to the impeller 34, and rotates together with the pump shaft 33 and the impeller 34. The fixed seal 352 is fixed to the pump housing 31, and does not rotate together with the pump shaft 33. The fixed seal 352 elastically contacts the rotary seal 351 by biasing of a spring included in the fixed seal 352. Contact between the rotary seal 351 and the fixed seal 352 prevents the cooling medium in the pump cover 32 from leaking to the side closer to the second end portion of the pump shaft 33.

The oil seal 36 is fixed to the pump housing 31, and does not rotate together with the pump shaft 33. The oil seal 36 elastically contacts the pump shaft 33. Contact between the oil seal 36 and the pump shaft 33 prevents the engine oil in the engine case 121 from leaking to the side closer to the first end portion of the pump shaft 33.

The pump 30 includes an introduction chamber 40. For the sake of simple illustration of the introduction chamber 40, the introduction chamber 40 is hatched with dots in FIG. 5. The introduction chamber 40 is separated by the mechanical seal 35 and the oil seal 36, and the cooling medium having leaked from the mechanical seal 35 is introduced into the introduction chamber 40. The cooling medium introduced into the introduction chamber 40 is not limited to a liquid cooling medium (for example, coolant water), and includes a vaporized cooling medium (for example, vapor). The introduction chamber 40 discharges the introduced cooling medium to the outside of the pump 30.

Specifically, the pump housing 31 includes an introduction space 312 separated by the mechanical seal 35 and the oil seal 36 and configured such that the cooling medium having leaked from the mechanical seal 35 is introduced thereinto. The introduction space 312 is a space defined by the pump housing 31, the pump shaft 33, the mechanical seal 35, the oil seal 36, and the impeller 34.

The pump 30 has a joint 38. The joint 38 is inserted into the pump housing 31, and communicates with the introduction space 312. The joint 38 is in a tubular shape, and includes an internal space 381. The drain hose 50 is connected to the joint 38. The drain hose 50 communicates with the internal space 381. The inlet 51 of the drain hose 50 is inserted into the joint 38. The drain hose 50 is fixed to the joint 38, for example, with a retaining ring.

The introduction chamber 40 includes the introduction space 312 of the pump housing 31 and the internal space 381 of the joint 38. The introduction chamber 40 communicates with the drain hose 50. With this configuration, the cooling medium introduced into the introduction chamber 40 is discharged to the outside of the vehicle pump assembly 13 through the drain hose 50.

Subsequently, operation of the pump 30 will be described.

When the pump shaft 33 is rotationally driven through the transmission shaft 39, the impeller 34 rotates together with the pump shaft 33. Accordingly, the cooling medium is sucked into the pump cover 32 from the suction port 321 communicating with the radiator. The cooling medium having flowed into the pump cover 32 is supplied with pressure by the impeller 34, and is discharged from the discharge port 322 to the engine 12. In this manner, the pump 30 circulates the cooling medium between the radiator and the engine 12.

At this time, the mechanical seal 35 seals the cooling medium in the pump cover 32. Even in this state, in a case where the cooling medium in the pump cover 32 has leaked from the mechanical seal 35, the leaked cooling medium is discharged from the drain hose 50 through the introduction chamber 40.

Figure 6:
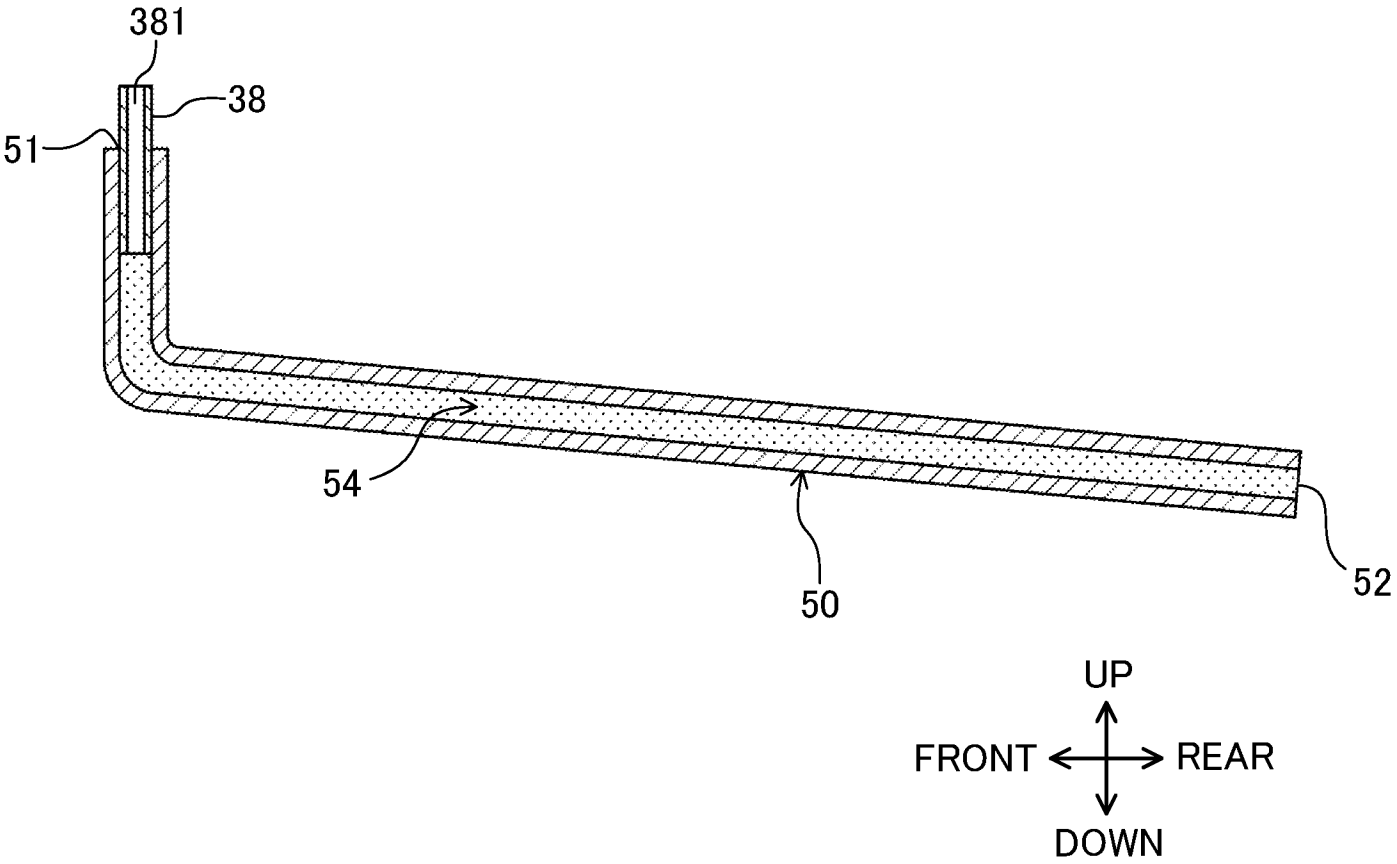
FIG. 6 is a sectional view of a drain hose and a joint.

FIG. 6 is a sectional view of the drain hose 50 and the joint 38. The drain hose 50 includes an internal space 54. For the sake of simple illustration of the internal space 54, the internal space 54 is hatched with dots in FIG. 6. The internal space 54 of the drain hose 50 communicates with the internal space 381 of the joint 38. The internal space 54 of the drain hose 50 is a region of a through-hole extending across the entire length of the drain hose 50 other than a region into which the joint 38 is inserted. That is, the internal space 54 of the drain hose 50 is a region from the tip end of the joint 38 to the outlet 52.

The internal volume of the drain hose 50 is three times the volume of the introduction chamber 40 or more, preferably 3.5 times or more. The internal volume of the drain hose 50 is the volume of the internal space 54. Hereinafter, the internal volume of the drain hose 50 will also be referred to as the volume of the internal space 54. The volume of the internal space 54 of the drain hose 50 is preferably 5.5 times the volume of the introduction chamber 40 or less, more preferably five times or less.

The sectional area of the internal space 54 of the drain hose 50 is preferably 28.3 $mm^2$ or more and 50.3 $mm^2$ or less. In other words, the equivalent circle diameter of the section of the internal space 54 is preferably 6 mm or more and 8 mm or less. The section of the internal space 54 is a section perpendicular to the long axis of the drain hose 50. For example, the section of the internal space 54 is in a circular shape, and the diameter of the section of the internal space 54 is 7.5 mm.

The sectional area of the internal space 54 is preferably substantially uniform across the long axis of the drain hose 50. Even if the sectional area of the internal space 54 is non-uniform across the long axis, the sectional area of the internal space 54 at least at the outlet 52 may preferably be 28.3 $mm^2$ or more and 50.3 $mm^2$ or less.

According to the above-described vehicle pump assembly 13, the volume of the internal space 54 of the drain hose 50 is three times the volume of the introduction chamber 40 or more. Thus, in a case where the vehicle pump assembly 13 is exposed to water from the outside, even if the outside water is sucked through the drain hose 50, the sucked outside water is less likely to enter the introduction chamber 40 of the pump 30.

The inventor(s) of the present application has newly conducted study on the phenomenon in which the water is sucked through the drain hose 50 in a case where the vehicle pump assembly 13 is exposed to the water. Specifically, the mechanical seal 35 has the rotary seal 351 rotating together with the pump shaft 33 and the fixed seal 352 fixed to the pump housing 31. The cooling medium in the pump 30 turns into vapor due to friction at a contact surface between the rotary seal 351 and the fixed seal 352, and a slight amount of vapor leaks to the introduction chamber 40 through the contact surface. In this state, when the pump 30 is exposed to the outside water such as muddy water, the vapor introduced into the introduction chamber 40 is rapidly cooled, and the introduction chamber 40 is brought into a negative pressure due to contraction of the vapor. Accordingly, the outside water is sucked through the drain hose 50 communicating with the introduction chamber 40 under the negative pressure. Thus, from this study on the phenomenon, the inventor(s) of the present application has newly focused on a relationship between the volume of the introduction chamber 40 and the volume of the internal space 54 of the drain hose 50, and as a result of intensive study, has found a relative relationship between the volume of the introduction chamber 40 and the volume of the internal space 54 of the drain hose 50.

Thus, for example, when a user drives the vehicle 100 and the pump 30 is exposed to the outside water accumulated on the ground, such as muddy water, even if the outside water is sucked through the drain hose 50, the sucked outside water is less likely to enter the introduction chamber 40 of the pump 30.

The outlet 52 of the drain hose 50 faces the rear of the vehicle, and therefore, the outside water is less likely to enter the drain hose 50 from the front of the vehicle when the vehicle travels forward.

The drain hose 50 is continuously inclined so as to be positioned lower as extending to the outlet 52 of the drain hose 50, and therefore, the outside water sucked into the drain hose 50 is easily discharged to the outside.

The volume of the internal space 54 of the drain hose 50 is 5.5 times the volume of the introduction chamber 40 or less, and therefore, the length of the drain hose 50 can be reduced. Thus, the cost of the drain hose 50 can be reduced. Moreover, an increase in an installation space for the drain hose 50 can be suppressed. Further, contact of the drain hose 50 with other components can be reduced. In addition, the inclination of the drain hose 50 can be ensured. Moreover, the number of supports 60 supporting the drain hose 50 can be reduced.

The sectional area of the internal space 54 of the drain hose 50 is 28.3 $mm^2$ or more and 50.3 $mm^2$ or less. Since the sectional area of the internal space 54 is 28.3 $mm^2$ or more, the sectional area of the internal space 54 can be increased, influence of surface tension in the drain hose 50 can be decreased, and the outside water sucked into the drain hose 50 can be smoothly discharged. Moreover, the sectional area of the internal space 54 can be increased, and the length of the drain hose 50 necessary for ensuring the volume of the internal space 54 can be decreased. On the other hand, since the sectional area of the internal space 54 is 50.3 $mm^2$ or less, the thickness of the drain hose 50 can be decreased.

According to the above-described vehicle 100, the volume of the internal space 54 of the drain hose 50 is three times the volume of the introduction chamber 40 or more. Thus, in a case where the vehicle pump assembly 13 is exposed to the water from the outside, even if the outside water is sucked through the drain hose 50, the sucked outside water is less likely to enter the introduction chamber 40 of the pump 30.

The vehicle 100 further includes the support 60 supporting the drain hose 50 on the side closer to the inlet 51 of the drain hose 50 with respect to the intermediate portion 53 of the drain hose 50, and therefore, the drain hose 50 can be easily continuously inclined so as to be positioned lower as extending to the outlet 52 of the drain hose 50. With this configuration, the outside water sucked into the drain hose 50 is easily discharged to the outside. Specifically, in a case where the drain hose 50 has the flexibility, the inclined posture of the drain hose 50 can be effectively ensured.

The support 60 is attached to the oil pan 14, and therefore, can be located near the pump 30. With this configuration, the drain hose 50 can be supported on the side closer to the inlet 51 of the drain hose 50 with respect to the intermediate portion 53 of the drain hose 50 without increasing the size of the support 60.

Specifically, in a case where the support 60 is located far from the pump 30, the support 60 extends long to the side closer to the inlet 51 with respect to the intermediate portion 53 of the drain hose 50 to support the drain hose 50, and for this reason, the support 60 is large. On the other hand, the support 60 is located near the pump 30 so that the drain hose 50 can be supported on the side closer to the inlet 51 with respect to the intermediate portion 53 of the drain hose 50 without increasing the length of the support 60. Thus, the support 60 can be small.

The support 60 is attached to the recess 141*a* of the peripheral wall 141 of the oil pan 14, and therefore, the support 60 can be attached to a dead space of the oil pan 14. With this configuration, an increase in an installation space for the support 60 can be suppressed.

The fastening-side end portion 65 of the support 60 positioned in the fastening direction F of the bolt 15 contacts the inner surface of the recess 141*a* as viewed in the direction of the axis 15*a* of the bolt 15. Thus, when the bolt 15 is fastened, even if the support 60 rotates together with the bolt 15, the fastening-side end portion 65 of the support 60 contacts the inner surface of the recess 141*a* so that co-rotation of the support 60 can be prevented. With this configuration, the support 60 can be reliably fixed to the oil pan 14.

The outlet 52 of the drain hose 50 is positioned, as viewed from below, between the rear end of the engine 12 and the front ends of the rear wheels 4. Since the outlet 52 of the drain hose 50 is positioned, as viewed from below, in rear with respect to the rear end of the engine 12, the outlet 52 of the drain hose 50 can be separated from the pump 30 attached to the engine 12 and the vapor introduced into the introduction chamber 40 of the pump 30 is less likely to reach the outlet 52 of the drain hose 50. Thus, the percentage of the volume of the vapor contracted by rapid cooling with respect to the volume of the internal space 54 of the drain hose 50 can be further reduced, and the amount of outside water sucked through the drain hose 50 can be further reduced. Moreover, since the outlet 52 of the drain hose 50 is positioned, as viewed from below, in front with respect to the front ends of the rear wheels 4, the length of the drain hose 50 can be reduced and exposure of the outlet 52 of the drain hose 50 to water splashed by the rear wheels 4 can be reduced.

EXAMPLE

Next, an example will be described. Study was conducted on whether or not the water sucked through the drain hose 50 enters the introduction chamber 40 while changing the ratio of the volume of the internal space 54 of the drain hose 50 to the volume of the introduction chamber 40 of the pump 30.

Figure 7:
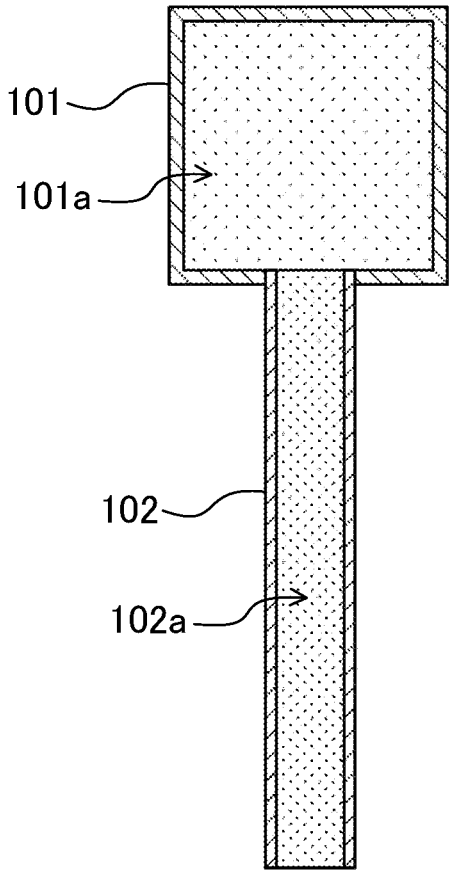
FIG. 7 is a sectional view showing such a model that an introduction chamber of a pump and an internal space of the drain hose are simulatively reproduced.

FIG. 7 is a sectional view showing such a model that the introduction chamber 40 of the pump 30 and the internal space 54 of the drain hose 50 are simulatively reproduced. A case 101 including the simulatively-reproduced introduction chamber 40 of the pump 30 was prepared. An internal space 101*a* of the case 101 was hatched with dots, and the volume of the internal space 101*a* of the case 101 was A. That is, the internal space 101*a* of the case 101 is equivalent to the introduction chamber 40, and the volume A of the internal space 101*a* of the case 101 is equivalent to the volume of the introduction chamber 40.

A hose 102 including the simulatively-reproduced internal space 54 of the drain hose 50 was prepared. An internal space 102*a* of the hose 102 was hatched with dots, and the volume of the internal space 102*a* of the hose 102 was B. That is, the internal space 102*a* of the hose 102 is equivalent to the internal space 54, and the volume B of the internal space 102*a* of the hose 102 is equivalent to the volume of the internal space 54.

A predetermined amount, e.g., several drops, of coolant water was supplied into the case 101, and by heating of the case 101, was changed into vapor. At this time, the tip end of the hose 102 was dipped in water stored in a container. Thereafter, the case 101 was rapidly cooled such that the internal space 101*a* of the case 101 is brought into a negative pressure, and the amount of water sucked from the container through the tip end of the hose 102 was measured. The amount of water sucked into the hose 102 was C.

While the ratio (B/A) of the volume B of the internal space 102*a* of the hose 102 to the volume A of the internal space 101*a* of the case 101 was changed to various ratios, the ratio (C/B) of the amount C of water sucked into the hose 102 to the volume B of the internal space 102*a* of the hose 102 was obtained. The unit of the volumes A, B, C was $cm^3$.

Here, a ratio (C/B) of greater than 1 means that the amount C of water sucked into the hose 102 is greater than the volume B of the internal space 102*a* of the hose 102 and the water sucked into the hose 102 enters the case 101. That is, this means that the water sucked through the drain hose 50 enters the introduction chamber 40.

On the other hand, a ratio (C/B) of less than 1 means that the amount C of water sucked into the hose 102 is less than the volume B of the internal space 102*a* of the hose 102 and the water sucked into the hose 102 does not enter the case 101. That is, this means that the water sucked through the drain hose 50 does not enter the introduction chamber 40.

Figure 8:
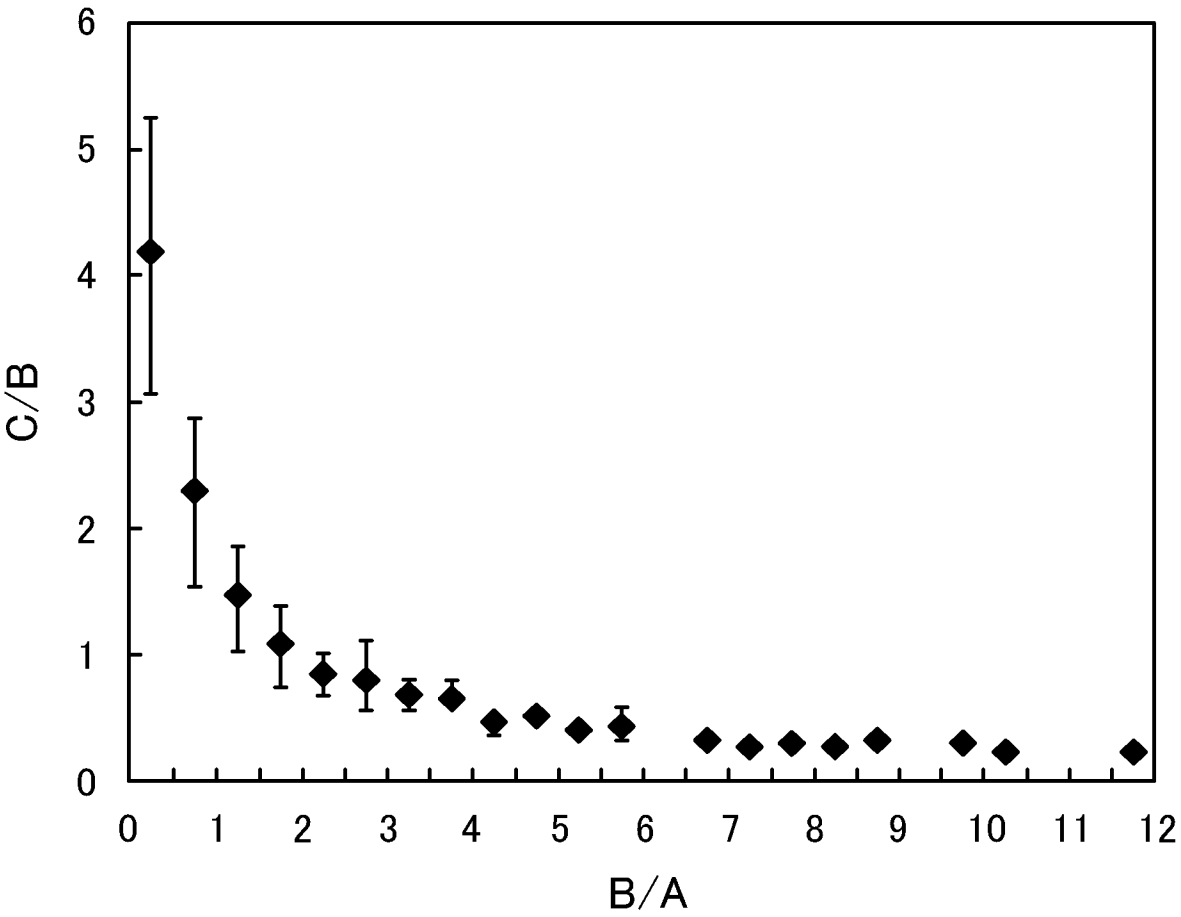
FIG. 8 is a graph showing a relationship between the ratio (B/A) of the volume B of an internal space of a hose to the volume A of an internal space of a case and the ratio (C/B) of the amount C of water sucked into the hose to the volume B of the internal space of the hose.

FIG. 8 is a graph showing a relationship between the ratio (B/A) and the ratio (C/B). In FIG. 8, the horizontal axis represents the ratio (B/A), and the vertical axis represents the ratio (C/B). In FIG. 8, a variation range for each plot is indicated by an error bar.

As seen from FIG. 8, in a case where the ratio (B/A) was less than 3, the ratio (C/B) exceeded 1 in some cases. That is, in a case where the volume B of the internal space 102*a* of the hose 102 was less than three times the volume A of the internal space 101*a* of the case 101, the water sucked into the hose 102 entered the case 101 in some cases. Thus, it can be said that when the volume of the internal space 54 of the drain hose 50 is less than three times the volume of the introduction chamber 40 of the pump 30, the water sucked through the drain hose 50 enters the introduction chamber 40 in some cases.

On the other hand, in a case where the ratio (B/A) was 3 or more, the ratio (C/B) was less than 1. That is, in a case where the volume B of the internal space 102*a* of the hose 102 was three times the volume A of the internal space 101*a* of the case 101 or more, the water sucked into the hose 102 did not enter the case 101. Thus, it can be said that when the volume of the internal space 54 of the drain hose 50 is three times the volume of the introduction chamber 40 of the pump 30 or more, the water sucked through the drain hose 50 does not enter the introduction chamber 40.

Particularly, in a case where the ratio (B/A) was 3.5 or more, the ratio (C/B) was more reliably less than 1. That is, it can be said that when the volume of the internal space 54 of the drain hose 50 is 3.5 times the volume of the introduction chamber 40 of the pump 30 or more, entrance of the water sucked through the drain hose 50 into the introduction chamber 40 is more reliably prevented.

In a case where the ratio (B/A) was 3 or more, the ratio (C/B) gradually decreased. In this case, as the ratio (B/A) increased, the rate of change in the decrease in the ratio (C/B) decreased. That is, even in a case where the ratio (B/A) increased, there was no significant difference in the amount of water sucked into the hose 102.

The increase in the ratio (B/A) means that the volume B of the internal space 102*a* of the hose 102 increases and, e.g., the length of the hose 102 increases. That is, even in a case where the length of the hose 102 increases, there is no significant difference in the amount of water sucked into the hose 102. Thus, when the ratio (B/A) was 5.5 or less, i.e., the volume B of the internal space 102*a* of the hose 102 was 5.5 times the volume A of the internal space 101*a* of the case 101 or less, the length of the hose 102 could be reduced and entrance of the water sucked into the hose 102 into the hose 102 could be prevented. Consequently, it can be said that when the volume of the internal space 54 of the drain hose 50 is 5.5 times the volume of the introduction chamber 40 of the pump 30 or less, the length of the drain hose 50 can be reduced and entrance of the water sucked through the drain hose 50 into the introduction chamber 40 can be prevented.

Particularly, in a case where the ratio (B/A) was 5 or less, the length of the hose 102 could be further reduced. That is, it can be said that when the volume of the internal space 54 of the drain hose 50 is five times the volume of the introduction chamber 40 of the pump 30 or less, the length of the drain hose 50 can be further reduced.

<<Modification>>

Figure 9:
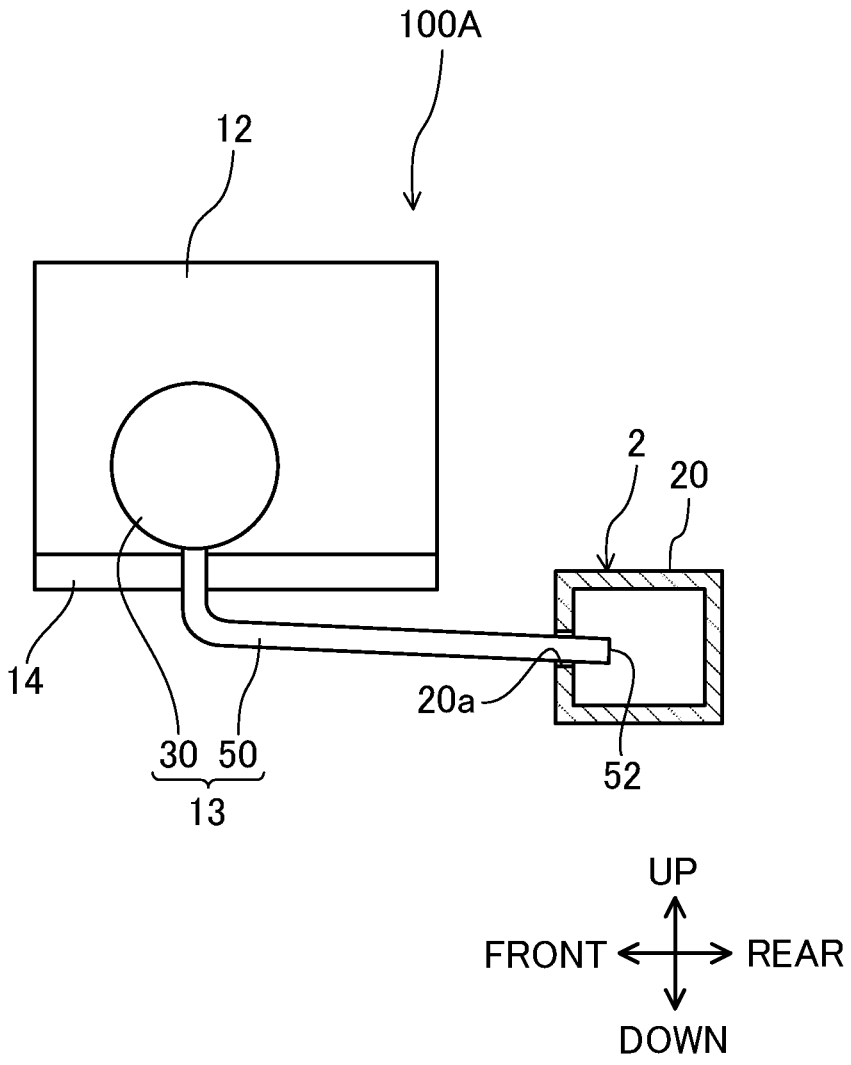
FIG. 9 is a schematic side view showing an engine, a vehicle pump assembly, and a vehicle body frame in a utility vehicle according to a modification.

FIG. 9 is a schematic side view showing an engine 12, a vehicle pump assembly 13, and a vehicle body frame 2 in a vehicle 100A according to a modification. Hereinafter, a different configuration of the vehicle 100A according to the modification from that of the vehicle 100 according to the embodiment will be mainly described. Note that in the vehicle 100A according to the modification, the same reference numerals as those of the vehicle 100 according to the embodiment represent the same components as those of the vehicle 100 according to the embodiment, and therefore, description thereof will be omitted.

In the vehicle 100A according to the modification, the outlet-52-side end portion of the drain hose 50 is inserted into the hollow pipe 20 of the vehicle body frame 2. Specifically, the pipe 20 has a hole 20*a* allowing communication between the outside and inside of the pipe 20. The outlet-52-side end portion of the drain hose 50 is inserted into the hole 20*a* of the pipe 20, and the outlet 52 of the drain hose 50 is positioned inside the pipe 20.

According to the vehicle 100A of the modification, the outlet-52-side end portion of the drain hose 50 is inserted into the pipe 20, and therefore, exposure of the outlet 52 of the drain hose 50 to outside water can be reduced and suction of the outside water through the drain hose 50 can be reduced.

Note that although description of other configurations, features, and effects will be omitted, description of the vehicle 100 according to the embodiment can be used in description of the vehicle 100A according to the modification.

Other Embodiments

The embodiment has been described above as an example of the technique disclosed in the present application. However, the technique in the present disclosure is not limited to above, and is also applicable to embodiments to which changes, replacements, additions, omissions, etc. are made as necessary. The components described above in the embodiment may be combined to form a new embodiment. The components shown in the attached drawings and described in detail may include not only components essential for solving the problems, but also components that are provided for describing an example of the above-described technique and are not essential for solving the problems. Thus, description of these non-essential components in detail and illustration of these components in the attached drawings shall not be interpreted that these non-essential components are essential.

In the above-described embodiment, the outlet 52 of the drain hose 50 faces the rear of the vehicle, but may face the front of the vehicle or face the right and left of the vehicle.

In the above-described embodiment, the drain hose 50 is continuously inclined so as to be positioned lower as extending to the outlet 52, but may be inclined in a stepwise manner so as to be positioned lower as extending to the outlet 52. Alternatively, the drain hose 50 may extend in the vertical direction, or may extend in the horizontal direction.

In the above-described embodiment, the outlet 52 of the drain hose 50 is positioned, as viewed from below, between the rear end of the engine 12 and the front ends of the rear wheels 4, but may overlap with the engine 12 as viewed from below.

In the above-described embodiment, the drain hose 50 is supported by the support 60, but a component for supporting the drain hose 50, such as the support 60, is not necessarily disposed.

In the above-described embodiment, the support 60 is attached to the oil pan 14, but may be attached to another component such as the engine case 121.

In the above-described embodiment, the peripheral wall 141 of the oil pan 14 includes the recess 141*a*, but does not necessarily include the recess 141*a*.

In the above-described embodiment, the support 60 is attached to the recess 141*a*, but may be attached to the bottom of the oil pan 14.

In the above-described embodiment, the fastening-side end portion 65 of the support 60 contacts the inner surface of the recess 141*a* as viewed in the direction of the axis 15*a* of the bolt 15, but may be separated from the inner surface of the recess 141*a*.

In the above-described embodiment, the pump 30 has the mechanical seal 35 and the oil seal 36, but may have only the mechanical seal 35 without the oil seal 36. In this case, the introduction chamber 40 is a space separated by the mechanical seal 35.

In the above-described embodiment, the pump 30 has the joint 38, and the introduction chamber 40 includes the introduction space 312 of the pump housing 31 and the internal space 381 of the joint 38. However, instead of the joint 38, a connection portion for connecting the drain hose 50 to the pump housing 31 may be integrated, and in this case, the introduction chamber 40 includes the introduction space 312 of the pump housing 31.

In the above-described embodiment, the upper limit of the internal volume (volume of the internal space 54) of the drain hose 50 is 5.5 times the volume of the introduction chamber 40, but may be a numerical value greater than 5.5 times.

The technique disclosed here may be applied to an off-road vehicle other than the utility vehicle 100.

[Aspects]

The above-described embodiment is a specific example of the following aspects.

(First Aspect)

The vehicle pump assembly 13 includes the pump 30 having the mechanical seal 35 sealing the cooling medium, and the drain hose 50 attached to the pump 30. The pump 30 includes the introduction chamber 40 separated by the mechanical seal 35 and configured such that the cooling medium having leaked from the mechanical seal 35 is introduced thereinto, and the drain hose 50 communicates with the introduction chamber 40. The internal volume of the drain hose 50 is three times the volume of the introduction chamber 40 or more.

According to this configuration, the internal volume of the drain hose 50 is three times the volume of the introduction chamber 40 or more. Thus, in a case where the vehicle pump assembly 13 is exposed to water from the outside, even if the outside water is sucked through the drain hose 50, the sucked outside water is less likely to enter the introduction chamber 40 of the pump 30.

(Second Aspect)

In the vehicle pump assembly 13 of the first aspect, the outlet 52 of the drain hose 50 faces the rear of the vehicle.

According to this configuration, the outlet 52 of the drain hose 50 faces the rear of the vehicle, and therefore, the outside water is less likely to enter the drain hose 50 from the front of the vehicle when the vehicle travels forward.

(Third Aspect)

In the vehicle pump assembly 13 of the first or second aspect, the drain hose 50 is continuously inclined so as to be positioned lower as extending to the outlet 52 of the drain hose 50.

According to this configuration, the drain hose 50 is continuously inclined so as to be positioned lower as extending to the outlet 52 of the drain hose 50, and therefore, the outside water sucked into the drain hose 50 is easily discharged to the outside.

(Fourth Aspect)

In the vehicle pump assembly 13 of any one of the first to third aspects, the internal volume of the drain hose 50 is 5.5 times the volume of the introduction chamber 40 or less.

According to this configuration, the internal volume of the drain hose 50 is 5.5 times the volume of the introduction chamber 40 or less, and therefore, the length of the drain hose 50 can be reduced.

(Fifth Aspect)

The utility vehicle 100 (off-road vehicle) includes the engine 12 and the vehicle pump assembly 13 that supplies the cooling medium to the engine 12. The vehicle pump assembly 13 includes the pump 30 having the mechanical seal 35 sealing the cooling medium and attached to the engine 12, and the drain hose 50 attached to the pump 30. The pump 30 includes the introduction chamber 40 separated by the mechanical seal 35 and configured such that the cooling medium having leaked from the mechanical seal 35 is introduced thereinto, and the drain hose 50 communicates with the introduction chamber 40. The internal volume of the drain hose 50 is three times the volume of the introduction chamber 40 or more.

According to this configuration, the internal volume of the drain hose 50 is three times the volume of the introduction chamber 40 or more. Thus, in a case where the vehicle pump assembly 13 is exposed to water from the outside, even if the outside water is sucked through the drain hose 50, the sucked outside water is less likely to enter the introduction chamber 40 of the pump 30.

(Sixth Aspect)

The utility vehicle 100 of the fifth aspect further includes the support 60 supporting the drain hose 50 on the side closer to the inlet 51 of the drain hose 50 with respect to the intermediate portion 53 of the drain hose 50.

According to this configuration, the utility vehicle 100 further includes the support 60 supporting the drain hose 50 on the side closer to the inlet 51 of the drain hose 50 with respect to the intermediate portion 53 of the drain hose 50, and therefore, the drain hose 50 can be easily continuously inclined so as to be positioned lower as extending to the outlet 52 of the drain hose 50 from the inlet 51 of the drain hose 50. With this configuration, the outside water sucked into the drain hose 50 is easily discharged to the outside.

(Seventh Aspect)

The utility vehicle 100 of the fifth or sixth aspect further includes the oil pan 14 attached to the engine 12. The support 60 is attached to the oil pan 14.

According to this configuration, the support 60 is attached to the oil pan 14, and therefore, can be located near the pump 30. With this configuration, the drain hose 50 can be supported on the side closer to the inlet 51 of the drain hose 50 with respect to the intermediate portion 53 of the drain hose 50 without increasing the size of the support 60. Thus, the drain hose 50 can be easily continuously inclined so as to be positioned lower as extending to the outlet 52 of the drain hose 50 from the inlet 51 of the drain hose 50, and the outside water sucked into the drain hose 50 can be easily discharged to the outside.

(Eighth Aspect)

In the utility vehicle 100 of any one of the fifth to seventh aspects, the peripheral wall 141 of the oil pan 14 includes the recess 141*a*, and the support 60 is attached to the recess 141*a*.

According to this configuration, the support 60 is attached to the recess 141*a* of the peripheral wall 141 of the oil pan 14, and therefore, the support 60 can be attached to the dead space of the oil pan 14. With this configuration, an increase in the installation space for the support 60 can be suppressed.

(Ninth Aspect)

The utility vehicle 100 of any one of the fifth to eighth aspects further includes the bolt 15 (fastener) fixing the support 60 to the oil pan 14. As viewed in the direction of the axis 15*a* of the bolt 15, the end portion 65 of the support 60 positioned in the fastening direction F of the bolt 15 contacts the inner surface of the recess 141*a*.

According to this configuration, the fastening-side end portion 65 of the support 60 positioned in the fastening direction F of the bolt 15 contacts the inner surface of the recess 141*a* as viewed in the direction of the axis 15*a* of the bolt 15. Thus, when the bolt 15 is fastened, even if the support 60 rotates together with the bolt 15, the fastening-side end portion 65 of the support 60 contacts the inner surface of the recess 141*a* so that co-rotation of the support 60 can be prevented. With this configuration, the support 60 can be reliably fixed to the oil pan 14.

(Tenth Aspect)

The utility vehicle 100 of any one of the fifth to ninth aspects further includes the front wheels 3 and the rear wheels 4. The engine 12 is positioned between the front wheels 3 and the rear wheels 4, and the outlet 52 of the drain hose 50 is positioned, as viewed from below, between the rear end of the engine 12 and the front ends of the rear wheels 4.

According to this configuration, the outlet 52 of the drain hose 50 is positioned, as viewed from below, between the rear end of the engine 12 and the front ends of the rear wheels 4. Since the outlet 52 of the drain hose 50 is positioned, as viewed from below, in rear with respect to the rear end of the engine 12, the outlet 52 of the drain hose 50 can be separated from the pump 30 attached to the engine 12 and the vapor introduced into the introduction chamber 40 of the pump 30 is less likely to reach the outlet 52 of the drain hose 50. Thus, the percentage of the volume of the vapor contracted by rapid cooling with respect to the volume of the internal space 54 of the drain hose 50 can be further reduced, and the amount of outside water sucked through the drain hose 50 can be further reduced. Moreover, since the outlet 52 of the drain hose 50 is positioned, as viewed from below, in front with respect to the front ends of the rear wheels 4, the length of the drain hose 50 can be reduced and exposure of the outlet 52 of the drain hose 50 to the water splashed by the rear wheels 4 can be reduced.

(Eleventh Aspect)

The utility vehicle 100A of any one of the fifth to tenth aspects further includes the vehicle body frame 2 including the hollow pipe 20. The outlet-52-side end portion of the drain hose 50 is inserted into the pipe 20.

According to this configuration, the outlet-52-side end portion of the drain hose 50 is inserted into the pipe 20, and therefore, exposure of the outlet 52 of the drain hose 50 to the outside water can be reduced and suction of the outside water through the drain hose 50 can be reduced.

What is claimed:

1. A vehicle pump assembly comprising:

a pump having a mechanical seal sealing a cooling medium; and a drain hose attached to the pump, wherein the pump includes an introduction chamber separated by the mechanical seal and configured such that the cooling medium having leaked from the mechanical seal is introduced thereinto, and the drain hose communicates with the introduction chamber, and an internal volume of the drain hose is three times a volume of the introduction chamber or more.

2. The vehicle pump assembly of claim 1, wherein an outlet of the drain hose faces a rear of a vehicle.

3. The vehicle pump assembly of claim 1, wherein the drain hose is continuously inclined so as to be positioned lower as extending to an outlet of the drain hose.

4. The vehicle pump assembly of claim 1, wherein the internal volume of the drain hose is 5.5 times the volume of the introduction chamber or less.

5. An off-road vehicle comprising:

an engine; and a vehicle pump assembly that supplies a cooling medium to the engine, wherein the vehicle pump assembly includes a pump having a mechanical seal sealing the cooling medium and attached to the engine, and a drain hose attached to the pump, the pump includes an introduction chamber separated by the mechanical seal and configured such that the cooling medium having leaked from the mechanical seal is introduced thereinto, and the drain hose communicates with the introduction chamber, and an internal volume of the drain hose is three times a volume of the introduction chamber or more.

6. The off-road vehicle of claim 5, further comprising:

a support supporting the drain hose on a side closer to an inlet of the drain hose with respect to an intermediate portion of the drain hose.

7. The off-road vehicle of claim 6, further comprising:
an oil pan attached to the engine,
wherein the support is attached to the oil pan.

8. The off-road vehicle of claim 7, wherein
a peripheral wall of the oil pan includes a recess, and
the support is attached to the recess.

9. The off-road vehicle of claim 8, further comprising:
a fastener fixing the support to the oil pan,
wherein as viewed in an axial direction of the fastener, an end portion of the support positioned in a fastening direction of the fastener contacts an inner surface of the recess.

10. The off-road vehicle of claim 5, further comprising:
a front wheel and a rear wheel,
wherein the engine is positioned between the front wheel and the rear wheel, and
an outlet of the drain hose is positioned, as viewed from below, between a rear end of the engine and a front end of the rear wheel.

11. The off-road vehicle of claim 5, further comprising:
a vehicle body frame including a hollow pipe,
wherein an outlet-side end portion of the drain hose is inserted into the pipe.

* * * * *